US006035749A

United States Patent [19]

Haselwander

[11] Patent Number: 6,035,749

[45] **Date of Patent: *Mar. 14, 2000**

[54] PATTERNED SHEARING OF PILE FABRICS

[76] Inventor: Jack G. Haselwander, 726 Morning Shadows Dr., Chattanooga, Tenn. 37421

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,066

[22] Filed: Jul. 22, 1997

[51] Int. Cl.[7] ..... D06C 23/02

[52] U.S. Cl. ..... 83/22; 83/76.1; 83/76.9; 83/176; 83/349; 83/915; 83/869; 26/86; 26/16

[58] Field of Search ..... 26/86, 8 R, 15 R, 26/16; 28/163; 83/861, 869, 17, 18, 19, 20, 22, 76.1, 76.4, 76.9, 169, 175, 176, 177, 331, 349, 910, 915, 949, 950, 72

[56] References Cited

U.S. PATENT DOCUMENTS

| | | | |
|---|---|---|---|
| 1,052,934 | 2/1913 | Mallory | 26/15 R |
| 1,737,085 | 11/1929 | Horstmann | 26/16 |
| 1,737,086 | 11/1929 | Horstmann | 26/16 |
| 3,785,016 | 1/1974 | Hergert | 26/16 X |
| 3,818,554 | 6/1974 | Davidson | 26/16 |
| 4,262,568 | 4/1981 | Wallis | 83/176 |
| 4,649,606 | 3/1987 | Fay | 26/15 R |
| 4,882,818 | 11/1989 | Weathers et al. | 26/15 R |
| 5,016,328 | 5/1991 | Gilpatrick | 26/7 |
| 5,165,151 | 11/1992 | Nakagawa | 26/16 |
| 5,379,498 | 1/1995 | Nielsen et al. | 26/15 R |
| 5,446,950 | 9/1995 | Shibata | 26/15 R |

*Primary Examiner*—Rinaldi I. Rada
*Assistant Examiner*—Boyer Ashley
*Attorney, Agent, or Firm*—Alan Ruderman; Miller & Martin LLP

[57] ABSTRACT

A method and apparatus by which selected pile across the face of a web of pile fabric such as carpet may be raised or lowered in accordance with a pattern as the fabric passes through shearing apparatus so that certain pile of the pile may be sheared more than other pile to provide a sculptured affect. Nozzles extend across the width of the fabric and apply jets of air from controllable valves to impinge on the pile in its path to compress or raise selected pile in accordance with a pattern controller which controls the valves. Locating the nozzles so that jets of air impinge on the pile upstream from the shearing apparatus in a direction downstream toward the shearing apparatus will raise the pile while locating the nozzles so that the jets of air impinge upon the pile prior to the shearing location in an upstream direction will compress the pile. The pile which is raised is cut further than pile which is not raised and cut even further than the pile that is compressed. Pile which is cut more than the other pile will result in lower pile in the sculptured carpet.

16 Claims, 5 Drawing Sheets

PATTERNED SHEARING OF PILE FABRICS

BACKGROUND OF THE INVENTION

This invention relates to shearing of pile fabrics and more particularly to the shearing of carpet tufts and other pile in accordance with a pattern as the carpet is being fed so as to create a sculptured effect in the face or pile of the carpet.

In the art of manufacturing carpet, after the yarn has been tufted into a primary backing to form pile extending from the backing the stitches are locked therein by latex adhesive applied to the back of the primary backing, a secondary backing is thereafter attached and the latex is cured in an oven. Generally, especially in the case of cut pile carpet fabrics, the carpet is then fed through a shearing machine to tip shear the tufts. A conventional shearing machine comprises a rotating cylinder having a plurality of shearing blades which act against a stationary ledger blade. By shearing the tips, the surface of the carpet is leveled and made smooth.

Carpets may be tufted with a sculptured look by use of a pattern attachment in conjunction with the tufting machine. For example, carpet having pile tufts at a first level and loop pile tufts at a second level are well known, as are carpets having two levels of loop pile and two levels of cut pile. Such a pattern attachment operates by pulling back or back robbing yam from a prior stitch selectively to form the lower level pile. The cut pile tufts in these carpets additionally have to be tip sheared or the end product is not aesthetically appealing.

In Nakagawa U.S. Pat. No. 5,165,151 moveable fingers are controlled to lift the carpet backing and thus the pile at that location upwardly selectively closer to a cutter in accordance with a pattern so that selected pile is sheared. Since the carpet backing, which is relatively heavy, is moved, the patterning available with such apparatus is at best limited. A similar approach may have been tried where areas or surfaces of the carpet were raised to shear a portion of the pile in accordance with a pattern, but it does not appear to be in the patented art.

Clearly, since most carpet, at least cut pile carpet, are tip sheared, it is desirable to use the tip shearing procedure to provide a sculptured look rather than patterning in high-low fashion by the tufting process and subsequently tip shearing the pile.

SUMMARY OF THE INVENTION

Consequently, it is a primary object of the present invention to provide a method and apparatus for shearing the pile of pile fabrics selectively in accordance with a pattern to provide a sculptured look.

It is another object of the present invention to provide a method and apparatus for shearing the pile of a carpet in accordance with a pattern so that certain of the pile is sheared more than other of the pile in accordance with a pattern to provide a sculptured effect in the face of the carpet.

It is another object of the present invention to provide a method and apparatus for blowing a gaseous fluid or the like through nozzles extending across the width of a carpet or other pile fabric to compress or raise selected areas of the pile prior to the carpet entering the nip of shearing apparatus so as to shear raised pile a greater amount than pile that is not raised and to shear the compressed pile less than pile which is raised and pile which is not otherwise changed in height.

Accordingly, the present invention provides a method and apparatus whereby selected pile across the face of a web of pile fabric such as a carpet may be raised or lowered selectively in accordance with a pattern as the fabric passes through shearing apparatus so that certain of the pile may be sheared more than other pile to provide a sculptured effect. To this end a plurality of jets are provided extending across the width of the fabric, the jets supplying fluid in a gaseous form such as air fed from controllable valves. Activation of selected valves results in the fluid flowing through the nozzles and exiting as a jet to impinge on the pile in its path thereby compressing or raising selected areas of pile. Activation of the valves and thus the nozzles is effected by a pattern controller.

The pile fabric is fed to shearing apparatus which shears or cuts a greater portion of the pile which has been raised and/or a lesser portion of the pile which has been compressed. The shearing apparatus preferably comprises a rotating cylinder having a plurality of circumferencially spaced apart shearing blades which cooperate with a fixed ledger blade to shear or sever the tips of the pile passing over a guide bar positioning the pile between the moving blades and the fixed blade at the location of severing. Thus, locating the nozzles so that the jets are fluid impinge upon the pile upstream from the shearing apparatus in a direction downstream toward the shearing apparatus will raise the pile resulting in a greater amount of the tips of the pile being severed such that a shorter pile will result in those areas. If the nozzles are located so that the jets of fluid impinge upon the pile just prior to the shearing location in an upstream direction, then the pile just prior to severing will be compressed and a lesser amount of the tips of the pile will be sheared or severed resulting in higher pile. Both raising and lowering pile jets may be used together if desired. Alternatively, the jets may be located upstream of the severing apparatus to provide the raising and/or lowering of the pile prior to the pile being severed.

Any conventional pattern controller such as a transparent pattern drum having a pattern mounted thereon with light emitters and photocell receivers or a general purpose computer programmed with a pattern may be used to control the activation of the valves and thus the jets emitted from the nozzles. In any event the pattern may be repeated across the width of the fabric in a manner desired.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
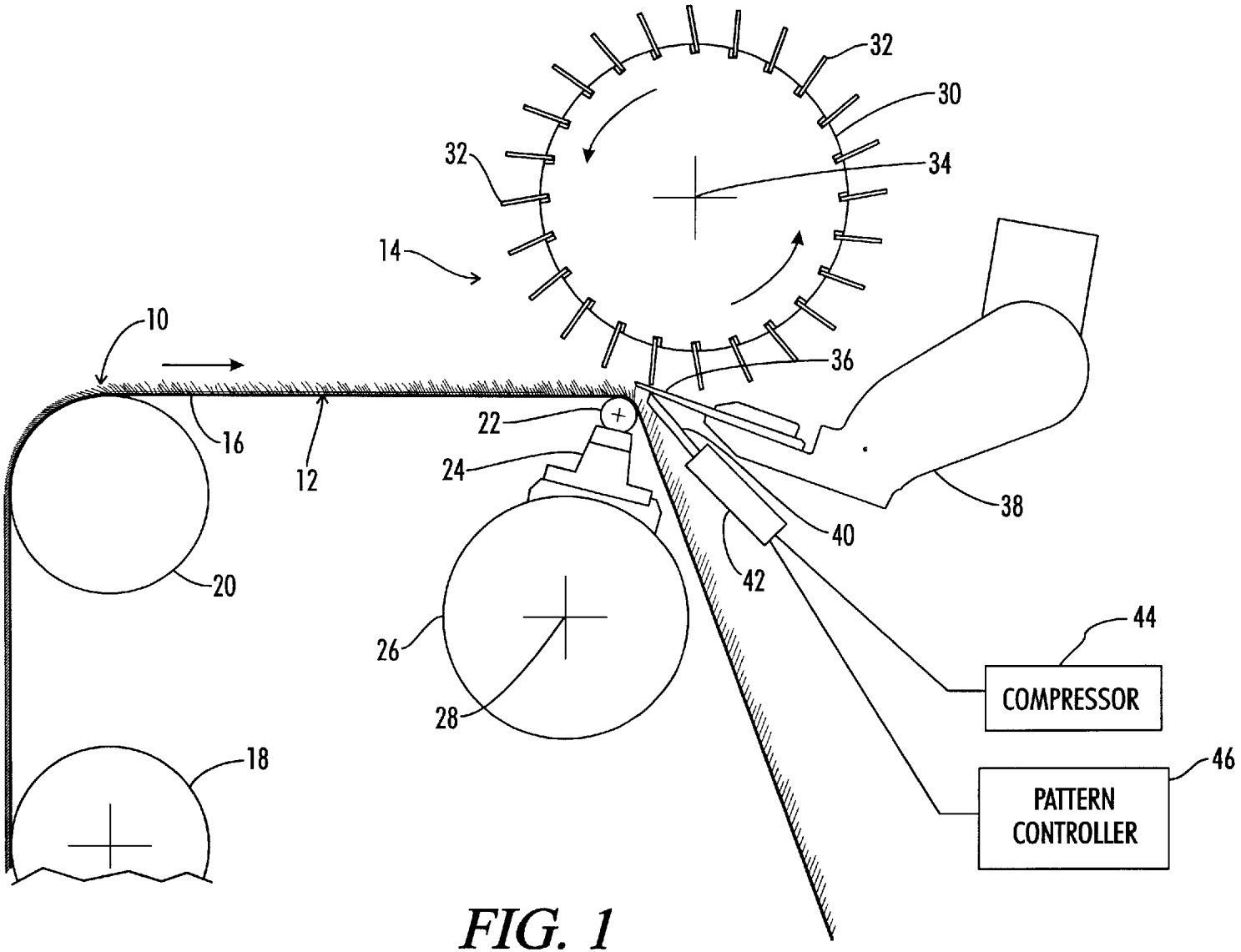
FIG. 1 is a diagrammatic side elevational view of a first embodiment of severing apparatus constructed in accordance with the principles of the present invention.

Referring to the drawings, a preferred form of the present invention is illustrated in FIG. 1 wherein portions of the pile 10 of a pile fabric 12 are compressed just prior to entering the severing zone of severing apparatus 14. Preferably, the pile fabric 12 may be a web of carpet wherein the pile comprises tufts which have been tufted into a primary backing and locked therein by adhesive to which a secondary backing is secured. Thus, the tufts or pile 10 are illustrated as extending from a backing 16 comprising a composite of the primary and secondary backings. The backing 16 may be fed from a curing oven or other accessory over rollers 18, 20 and directed over a guide bar or nose bar 22 in the form of a roller positioned substantially at the location of severing, the direction of the pile being sloped rearwardly, i. e., upstream, the pile actually laying on its side and directed upstream due to prior operations thereon. The nose bar 22 is mounted on a support 24 which may be secured to a cylindrical housing 26 adjustably mounted about the cylindrical center 28. The nose bar supports the material during cutting and opens the pile structure so that the pile may be severed, i.e., when the fabric is passed over the nose bar the rows of tufts are separated so as to be readily severed.

Disposed circumferentially about a rotatably driven cylindrical drum 30 is a plurality of shearing blades 32, the blades extending from the circumference off-set from the center 34 so as not to be radially disposed but to be disposed behind the center 34 in the direction of rotation. The blades 32 act individually in seriatim in conjunction with a fixed ledger blade 36 as the drum 30 rotates so that each blade 32 in sequence cuts or shears the tips or ends of pile 10 in conjunction with the ledger blade 36 as is well known in the art. The ledger blade is fixedly secured to a support 38 in the apparatus 14. The position at which cutting of the tips of the pile preferably occurs is slightly downstream of the contact of the nose bar roller 22 with the carpet backing, i.e., at the location of the tip of the ledger blade along a line drawn between the centers 28, 34 of the housing 26 and the drum 30 respectively. The nose bar roller 22 is slightly upstream from this location so that the center of the nose bar roller to each of the centers 28, 34 is upstream of this location. Generally, the amount of cut may be varied by moving the drum 30 relative to the housing 26 so that the blades 32 may be moved closer or further from the nose bar roller 22.

In accordance with the first embodiment of the present invention, the pile to be cut is compressed at or just prior to the location at which shearing occurs. To this end there is provided a series of nozzles 40 in the form of hollow needles or the like disposed across the width of the shearing apparatus, i.e., across the width of the carpet, the nozzles being spaced apart by a convenient distance so as to affect only a small section of pile of the carpet. Each nozzle is connected in flow communication with a controllable valve 42 such as a solenoid valve, the valve being connected in flow communication with a source of pressurized gaseous fluid, preferably a compressed air source such as a compressor 44. In some cases, rather than there being one valve 42 for each nozzle 40 there may be a valve associated with a manifold which supplies air to a number of nozzles. This could occur where there are a number of pattern repeats across the width of the pile fabric and each manifold then supplies air to nozzles disposed in similar positions relative to the pattern as is well known in the art of tufting carpet. However, for finer control where the pattern is not repeated there would be one valve for each nozzle. It may be noted that although air is the preferred fluid since compressed air is readily available in substantially all carpet mills, other gaseous fluids including carbon dioxide or steam, may be used. However, air has distinct obvious advantages.

Each valve is electrically connected to a pattern controller 46 of any convenient type whereby the pattern may be selectively varied such as a programmable logic controller with multiple outputs programmed with the desired commands as is well known in the art; see for example, Haselwander et al U.S. Pat. No. 5,594,968. Other controllers which may be utilized include a pattern drum about which a pattern sheet on acetate or the like is mounted, a light being disposed within the drum and photocells outside the drum to receive signals such as the pattern controller disclosed in Ingham et al U.S. Pat. No. 3,922,979. Controllers and computers performing pattern control features are today well known and used in the carpet manufacturing arts and no further discussion thereof is believed necessary.

Figure 2:
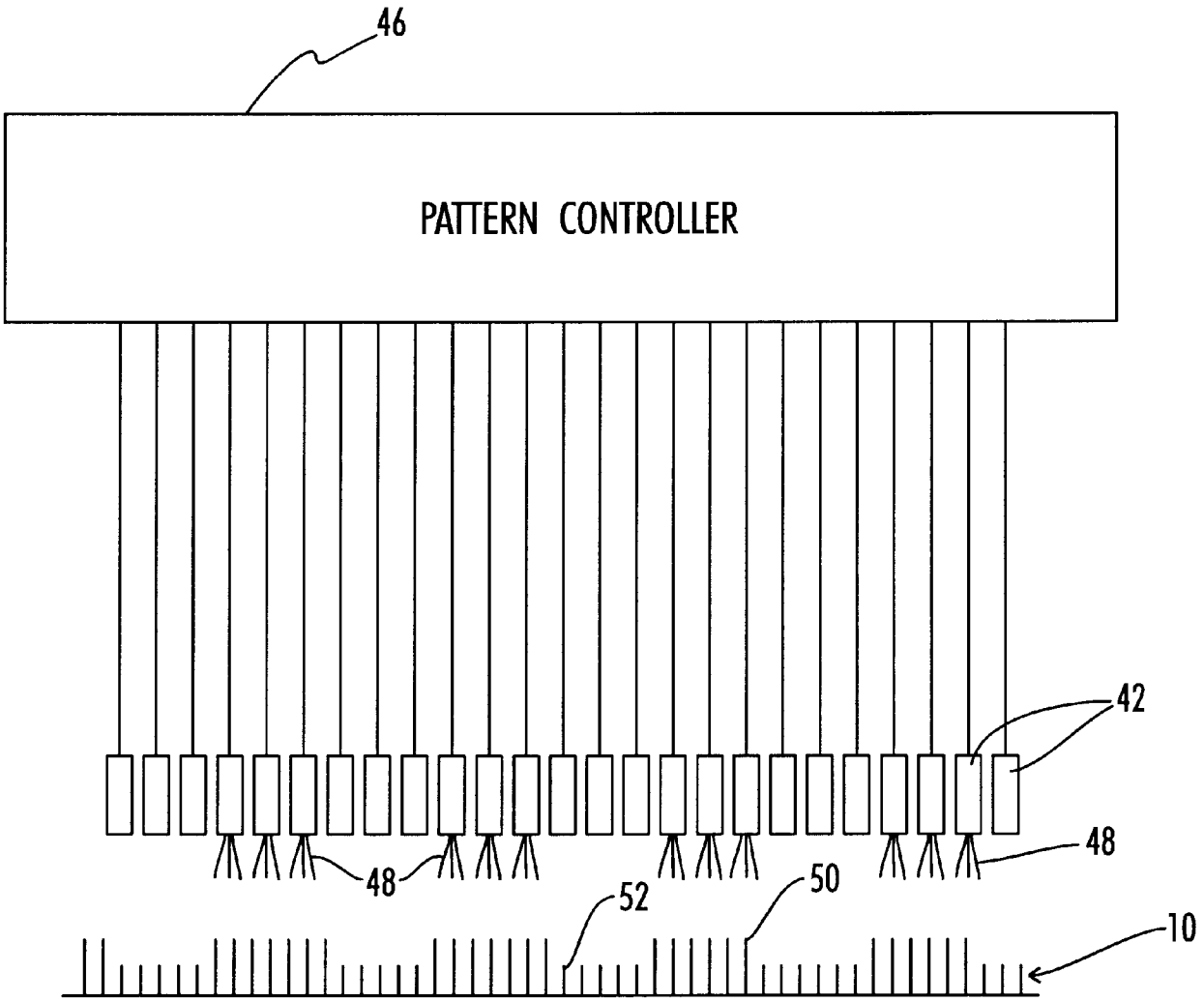
FIG. 2 is a schematic view illustrating a preferred manner of controlling the pattern of severing in accordance with the first embodiment and the product resulting therefrom.

In operation, as the pile 10 of the fabric 12 is fed over the guide bar nose roller 22 and the spacing between successive rows of pile is opened, air is blown through selective nozzles 40 as determined by the pattern and emitted therefrom as jets 48 for impinging upon and compressing the pile in the path of these jets. Thus, as the carpet is fed over the guide bar roller 22 certain of the pile is compressed by the jets of air while other of the pile is not affected. That pile which is compressed is not sheared or sheared less than the pile which is not compressed. As illustrated in FIG. 2, the pile 50 which is compressed by the air jets 48 is thus higher pile in the finished sculptured fabric than the pile 52 which has not been compressed.

Figure 3:
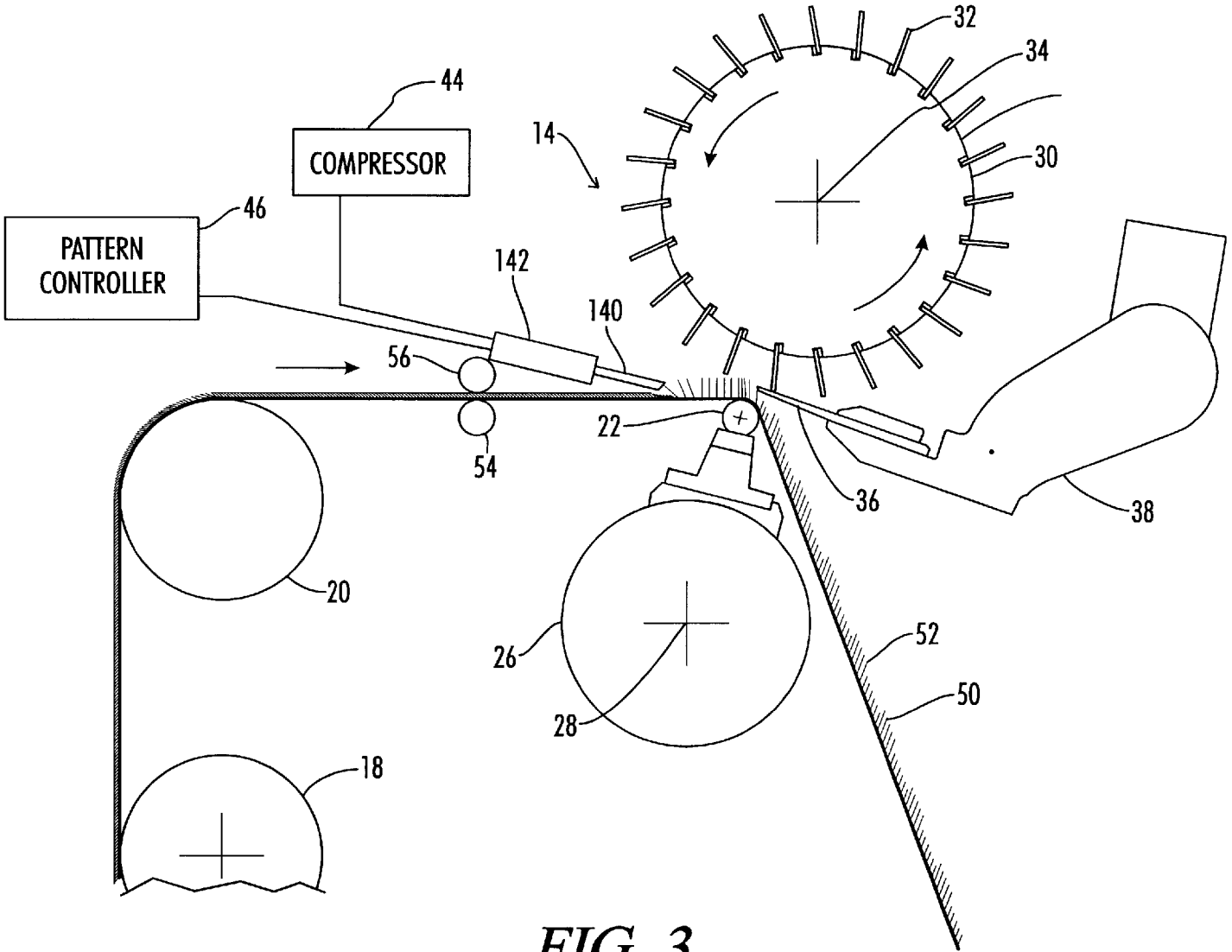
FIG. 3 is a view similar to FIG. 1 illustrating apparatus constructed in accordance with an alternate form of the present invention.
Figure 4:
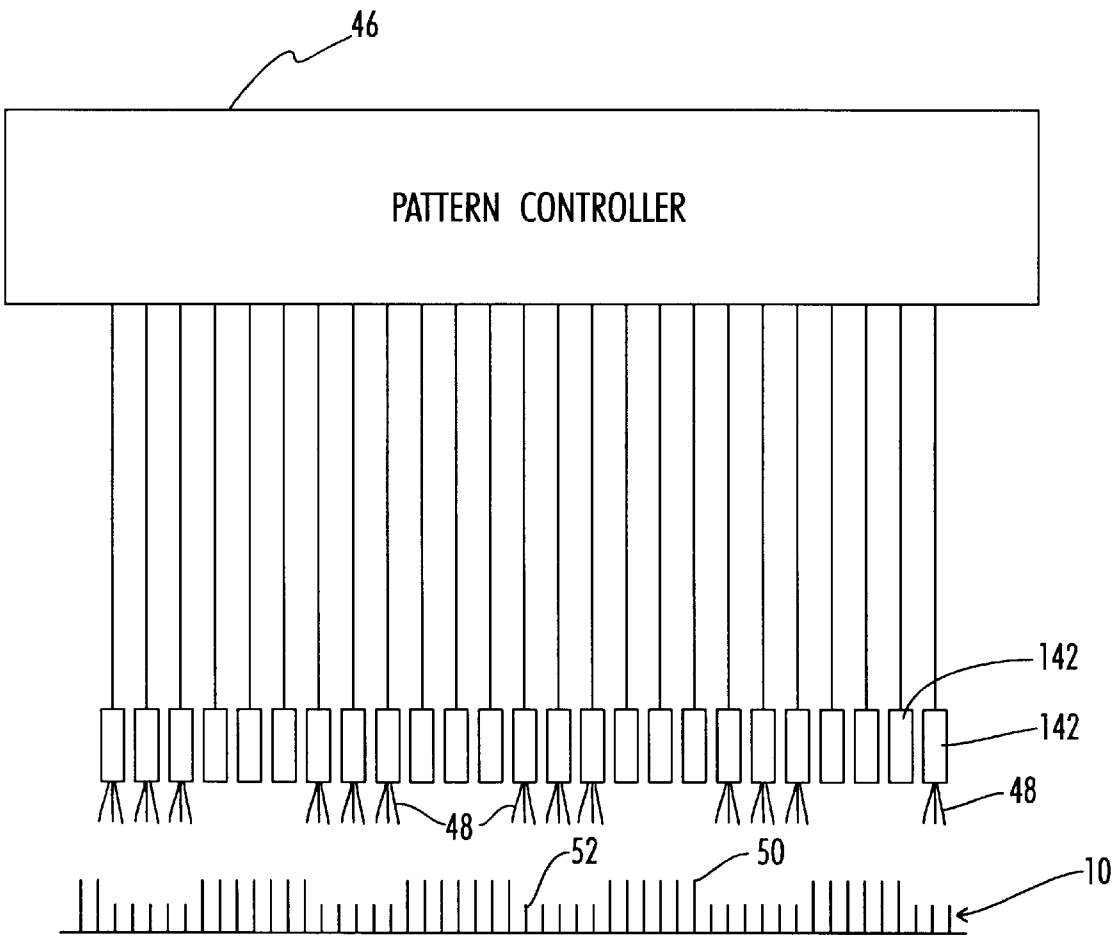
FIG. 4 is a view similar to FIG. 2, but illustrating the manner of controlling the pattern of the apparatus in FIG. 3 and the product formed therefrom.

Another form of the invention is illustrated in FIG. 3 wherein pile raising jets are applied to the carpet by blowing compressed gaseous fluid through nozzles 140 communicating with valves 142 or manifolds of the same form as that illustrated in FIG. 1. The nozzles 140 and valves 142 may be identical to the nozzles 40 and valves 42 in FIG. 1, but these nozzles are disposed upstream or ahead of the shearing apparatus 14 and emit jets of air downstream. As the jets of air engage the pile 12 the pile is deflected from its rearwardly extending slope and is raised. That pile which is raised is sheared a greater amount than pile which is not raised thereby resulting in shorter pile 52 in the finished sculptured fabric as illustrated in FIG. 4, while the pile not raised is either not cut or cut less and results in the higher pile 50. A set of squeeze rolls 54, 56 may be used in certain cases to compact the pile 10 of the fabric 12 before the patterning apparatus raises selected pile prior to the shearing.

If a greater differential between the high pile and the low pile is desired, or if three different levels of sculptured pile may be desirable, then the apparatus of FIG. 1 and FIG. 3 may be used together. Thus, although not deemed necessary to be illustrated, nozzles 140 before the shearing apparatus 14 blowing air downstream toward the shearing apparatus together with nozzles 40 at or downstream of the shearing apparatus blowing upstream to impinge on pile just prior to being sheared may be used to respectively provide a raising of certain pile and compressing of other pile. In this manner, a deep sculptured look may be obtained, or a three level sculpture effect obtained.

Figure 5:
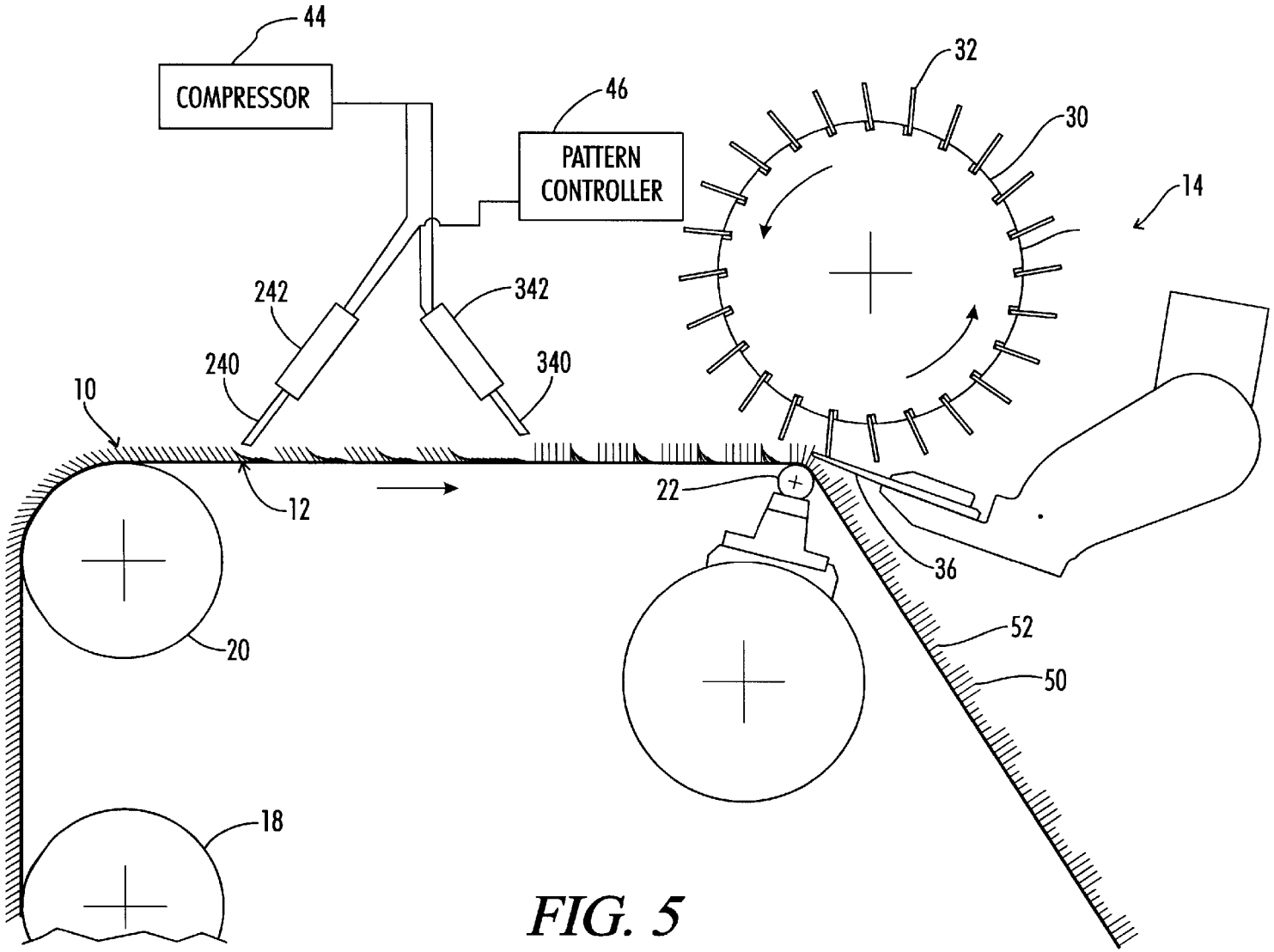
FIG. 5 is a view similar to FIG. 1 illustrating another modification of the present invention.

Another arrangement for obtaining a larger differential in pile heights in the finished product in certain fabrics is illustrated in FIG. 5. Here, a first set of nozzles 240 act to compress the pile while a second set of nozzles designated 340 act to raise the pile, both sets of nozzles being upstream or ahead of the shearing apparatus 14. The associated valves 242, 342 are connected to a pressurized gaseous fluid supply such as an air compressor 44 and controlled by pattern controller 46 as in the other embodiments. Here, the nozzles 240 blow jets upstream from its location to compress selected pile while the nozzles 340 blow jets of air downstream toward the shearing apparatus to raise selected pile. After being sheared the compressed pile, which is sheared less, results in higher pile 50 while the raised pile, which is cut a greater amount, results in low pile 52 in the final sculptured product.

Accordingly, the present invention in a relatively simple manner may sculpture carpet or other pile fabric by emitting jets of gaseous fluids such as air onto selected pile tufts to either lift or compress the pile in accordance with a pattern prior to the pile being sheared by shearing apparatus, thereby resulting in a greater cut being made on the lifted pile or a smaller cut being made on the compressed pile. If multiple pattern repeats across the width of the fabric is to occur, rather than a separate valve for each nozzle, it may be desirable to manifold nozzles together to feed air from each manifold to a number of nozzles and have a valve corresponding to one pattern repeat communicate with the respective manifold. In this manner, the number of valves may be reduced. If the pattern repeat is two feet wide, for example, and the carpet is 14 feed wide, there would be a total of seven pattern repeats. Thus, each valve supplied manifold would feed seven nozzles from seven distinct air hoses or tubes.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. The method of shearing pile extending from backing of pile fabric to provide a sculptured fabric, comprising:

providing a shearing apparatus positioned for shearing tips of pile extending from said pile fabric between a pair of blades, the greater a distance that said tips extend from said backing the greater an amount that is sheared, feeding said pile fabric to said shearing apparatus, blowing a gaseous fluid onto selected pile of said pile fabric in accordance with a pattern requiring at least two differing levels of pile to deflect said selected pile relative to unselected pile prior to said selected and unselected pile entering said shearing apparatus such that selected pile after the gaseous fluid is blown onto the selected pile project a different level from said backing relative to said unselected pile, and shearing one of said selected and unselected pile to sculpture said fabric with areas of selected pile projecting from said backing at a level which is different from the level at which unselected pile extends from said backing at areas of said unselected pile.

2. The method as recited in claim 1, wherein said gaseous fluid is directed to raise said selected pile relative to said unselected pile, and said shearing cuts a greater amount of said selective pile than of said unselected pile to provide areas of selected pile projecting from said backing less than areas of said unselected pile.

3. The method as recited in claim 2, wherein said gaseous fluid is blown onto said selected pile at an angle directed downstream relative to a direction of feeding of said pile fabric.

4. The method as recited in claim 1, wherein said gaseous fluid is directed to compress said selected pile relative to said unselected pile, and said shearing cuts a greater amount of said unselected pile than of said selected pile to provide areas of unselected pile projecting from said backing less than areas of said selected pile.

5. The method as recited in claim 4, wherein said gaseous fluid is blown onto said selected pile at an angle directed upstream relative to a direction of feeding of said pile fabric.

6. The method as recited in claim 4, including blowing said gaseous fluid onto certain pile to raise said certain pile above other pile in accordance with said pattern prior to entering said shearing apparatus to provide said sculptured fabric with areas of said certain pile extending a lesser amount from said backing than said other pile.

7. The method as recited in claim 6, wherein said gaseous fluid is blown onto said selected pile at an angle directed upstream relative to a direction of feeding of said pile fabric and is blown onto said certain pile at an angle directed downstream relative to the direction of feeding of said pile fabric.

8. The method of shearing pile extending from backing of pile fabric to provide a sculptured fabric, comprising:

a shearing apparatus positioned for shearing tips of pile extending from said pile fabric between a pair of blades, the greater a distance that said tips extend from said backing the greater an amount that is sheared, feeding said pile fabric in a first direction to said shearing apparatus, providing a plurality of spaced apart gaseous fluid blowing nozzles transversely relative to said first direction, blowing gaseous fluid through selected nozzles onto selected pile of said pile fabric in accordance with a pattern requiring at least two differing levels of pile to deflect said selected pile relative to unselected pile prior to said selected and unselected pile entering said sharing apparatus such that selected pile after the gaseous fluid is blown on to the selected pile project a different level from said backing relative to said unselected pile, and shearing one of said selected and unselected pile to sculpture said fabric with areas of selected pile projecting from said backing at a level which is different from the level at which unselected pile extends from said backing at areas of said unselected pile.

9. The method as recited in claim 8, wherein said gaseous fluid is directed to raise said selected pile relative to said unselected pile, and said shearing cuts a greater amount of said selected pile than of said unselected pile to provide areas of selected pile projecting from said backing less than areas of unselected pile.

10. The method as recited in claim 9, wherein said gaseous fluid is blown onto said selected pile at an angle downstream relative to a direction of feeding of said pile fabric.

11. The method as recited in claim 8, wherein gaseous fluid is directed to compress said selected pile relative to said unselected pile, and said shearing cuts greater amount of said unselected pile than of said selected pile to provide areas of unselected pile projecting from said backing less than areas of said selected pile.

12. The method as recited in claim 11, including blowing said gaseous fluid onto certain pile to raise said certain pile in accordance with said pattern prior to entering said shearing apparatus to provide said sculptured fabric with areas of said certain pile extending a lesser amount from said backing than said other pile.

13. The method as recited in claim 11, wherein said gaseous fluid is blown onto said pile at an angle directed upstream relative to a direction of feeding of said pile fabric.

14. The method as recited in claim 8, wherein said gaseous fluid blowing nozzles are spaced above the pile fabric and blow downwardly.

15. The method as recited in claim 14, wherein gaseous fluid is directed to compress said selected pile relative to said unselected pile, and said shearing cuts a greater amount of said unselected pile than of said selected pile to provide areas of unselected pile projecting from said backing less than areas of said selected pile.

16. The method as recited in claim 14, wherein said gaseous fluid is directed to raise said selected pile relative to said unselected pile, and said shearing cuts a greater amount of said selected pile than of said unselected pile to provide areas of selected pile projecting from said backing less than areas of unselected pile.

* * * * *